US011764482B1

(12) United States Patent
Lannon et al.

(10) Patent No.: US 11,764,482 B1
(45) Date of Patent: Sep. 19, 2023

(54) FLAT-PLATE ANTENNAS AND ANTENNA SYSTEMS

(71) Applicant: Cobham Advanced Electronic Solutions Inc., Arlington, VA (US)

(72) Inventors: Matthew Clayton Lannon, Pelham, NH (US); Samuel Patrick Burke, Arlington, MA (US)

(73) Assignee: COBHAM ADVANCED ELECTRONIC SOLUTIONS INC., Arlington, VA (US)

( * ) Notice: Subject to any disclaimer, the term of this patent is extended or adjusted under 35 U.S.C. 154(b) by 0 days.

(21) Appl. No.: 17/646,537

(22) Filed: Dec. 30, 2021

(51) Int. Cl.

| | |
|---|---|
| ***H01Q 21/00*** | (2006.01) |
| ***H01Q 13/10*** | (2006.01) |
| ***H01Q 13/08*** | (2006.01) |
| ***H01Q 21/06*** | (2006.01) |
| ***H01Q 13/18*** | (2006.01) |

(52) U.S. Cl.
CPC ..... *H01Q 21/005* (2013.01); *H01Q 13/085* (2013.01); *H01Q 13/10* (2013.01); *H01Q 13/18* (2013.01); *H01Q 21/064* (2013.01)

(58) Field of Classification Search
CPC ..... H01Q 21/005; H01Q 13/10; H01Q 13/18; H01Q 21/0043; H01Q 13/085; H01Q 21/064
See application file for complete search history.

(56) References Cited

U.S. PATENT DOCUMENTS

| | | | | |
|---|---|---|---|---|
| 5,726,666 A * | 3/1998 | Hoover | H01Q 13/22 | 343/770 |
| 6,124,833 A * | 9/2000 | Bialkowski | H01Q 21/0012 | 343/770 |
| 8,860,630 B2 * | 10/2014 | Kodama | H01Q 21/0037 | 343/897 |
| 10,454,184 B2 * | 10/2019 | Boutayeb | H01Q 21/24 | |

* cited by examiner

*Primary Examiner* — Vibol Tan
(74) *Attorney, Agent, or Firm* — ALSTON & BIRD LLP

(57) ABSTRACT

Flat-plate antennas, antenna systems, and associated methods of manufacturing are provided. An example flat-plate antenna includes an integral body defining a top portion, a bottom portion opposite the top portion, and one or more side portions extending therebetween. The body further defines a channel at least partially enclosed by the body. The flat-plate antenna further includes a plurality of top openings formed in the top portion and one or more bottom openings formed in the bottom portion. The body is configured such that the plurality of top openings are in communication with the one or more bottom openings via the channel such that, in operation, electromagnetic radiation may pass therebetween, such as generated by or received by a radio transceiver communicably coupled with the flat-plate antenna via the bottom portion of the body.

20 Claims, 6 Drawing Sheets

FLAT-PLATE ANTENNAS AND ANTENNA SYSTEMS

TECHNOLOGICAL FIELD

Example embodiments of the present disclosure relate generally to radio communication devices and, more particularly, to improved flat-plate antenna configurations.

BACKGROUND

Radio communication is used in a variety of applications, such as radio and television broadcasting, wireless networking, satellite communication, navigation, military applications, and the like, in which radio waves (e.g., electromagnetic radiation) are used to transmit information (e.g., data) across space. By way of example, radio communication may be used in navigation or RADAR (Radio Detection and Ranging) applications to determine the relative position of objects in space. In order to broadcast radio signals and/or receive emitted radio signals (e.g., from a corresponding radio transmitter), radio communication systems may leverage antenna assemblies that direct these radio waves. The inventors have identified numerous deficiencies with these existing technologies in the field, the remedies for which are the subject of the embodiments described herein.

BRIEF SUMMARY

Flat-plate antennas, antenna systems, and associated methods of manufacturing are provided. An example flat-plate antenna may include an integral body defining a top portion, a bottom portion opposite the top portion, and one or more side portions extending therebetween where the body defines a channel at least partially enclosed by the body. The flat-plate antenna may further include a plurality of top openings formed in the top portion and one or more bottom openings formed in the bottom portion. The body may be configured such that the plurality of top openings are in communication with the one or more bottom openings via the channel such that, in operation, electromagnetic radiation may pass therebetween.

In some embodiments, the body of the flat-plate antenna may be formed from a single piece of material.

In some embodiments, the body may be formed as a monolithic structure.

In some embodiments, the flat-plate antenna may further include one or more feed structures formed integral with the bottom portion of the body. The one or more feed structures may include the one or more bottom openings and provide communication between the one or more bottom openings and the channel.

In some embodiments, the one or more feed structures may include one or more corresponding turning portions configured to short at least a portion of the electromagnetic radiation traveling within the one or more feed structures.

In some further embodiments, at least one of the one or more turning portions may be disposed at a juncture between the bottom portion and the one or more side portions.

In other further embodiments, the manifold body may be formed integral with the one or more feed structures of the bottom portion.

In any embodiment, the flat-plate antenna may be operably or communicably coupled with a radio transceiver that generates electromagnetic radiation (e.g., radio signals) for emittance by the flat-plate antenna and/or receives electromagnetic radiation (e.g., radio signals) from the flat-plate antenna (e.g., an antenna system that includes the flat-plate antenna).

The above summary is provided merely for purposes of summarizing some example embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which will be further described below.

BRIEF DESCRIPTION OF THE DRAWINGS

Having described certain example embodiments of the present disclosure in general terms above, reference will now be made to the accompanying drawings. The components illustrated in the figures may or may not be present in certain embodiments described herein. Some embodiments may include fewer (or more) components than those shown in the figures.

DETAILED DESCRIPTION

Figure 1:
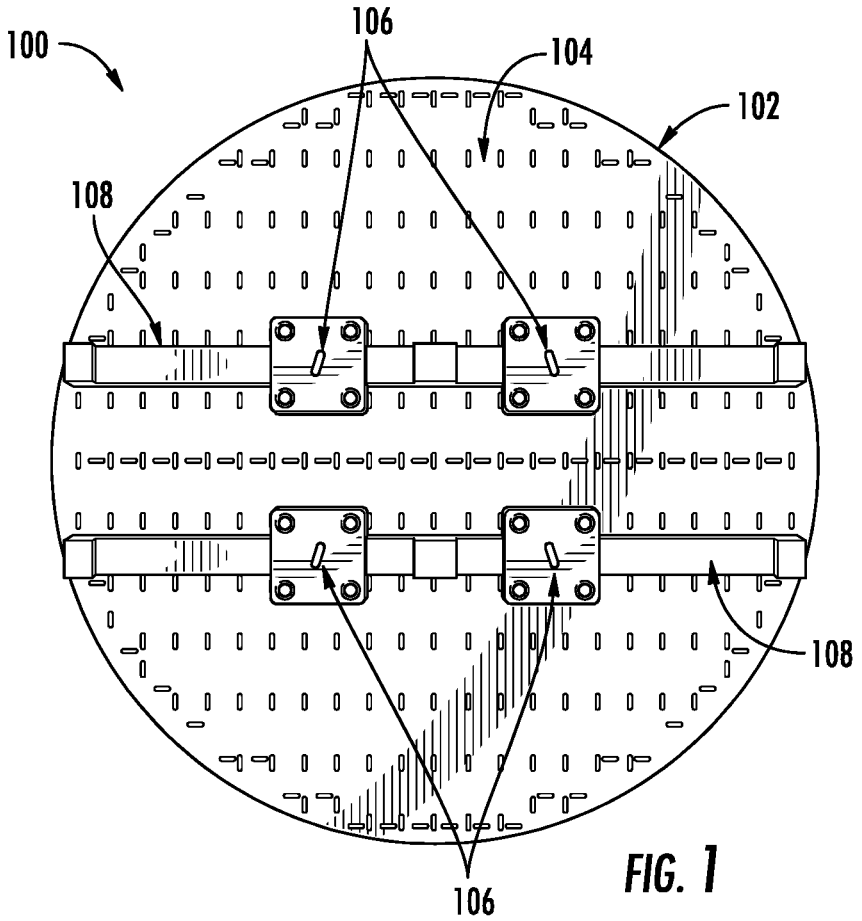
FIG. 1 illustrates a bottom view of a modular or disparate antenna assembly formed of a plurality of distinct elements in a disk, cylindrical, or circular configuration.

Some embodiments of the present disclosure will now be described more fully hereinafter with reference to the accompanying drawings, in which some, but not all embodiments of the disclosure are shown. Indeed, this disclosure may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

As used herein, the term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

As used herein, the phrases "in one embodiment," "according to one embodiment," "in some embodiments," and the like generally refer to the fact that the particular feature, structure, or characteristic following the phrase may be included in at least one embodiment of the present disclosure. Thus, the particular feature, structure, or characteristic may be included in more than one embodiment of the present disclosure such that these phrases do not necessarily refer to the same embodiment.

As used herein, the word "example" is used herein to mean "serving as an example, instance, or illustration." Any implementation described herein as "example" is not necessarily to be construed as preferred or advantageous over other implementations.

As used herein, the term "communication" may be selectively used to describe or otherwise define the conduit, waveguide, etc. by which electromagnetic radiation (e.g., radio signals or the like) may propagate. By way of example, the body of an example flat-plate antenna of the present disclosure may define a channel, conduit, opening, or the like at least partially bounded, enclosed, etc. by the body of the flat-plate antenna such that radio signals may be transmitted from one location to another. Said differently, the reference to communication herein may refer to the structural configuration or arrangement of the flat-plate antenna body that provides communication through the body. In other words, the communication provided by the body of the flat-plate antenna refers to any structure, construct, housing, enclosure, channel, conduit, waveguide, or the like through which electromagnetic radiation may propagate.

The embodiments of the present disclosure may be described herein with reference to a "flat-plate antenna" as an example device implementing various features described further hereinafter. The present disclosure, however, contemplates that a "flat-plate antenna" of the present disclosure may similarly refer to a "slot antenna," a slotted waveguide antenna," "a slotted waveguide array," and/or any device configured to emit electromagnetic radiation (e.g., radio waves, radio signals, etc.) via one or more openings (e.g., slots, holes, etc.) formed in a surface of said device.

OVERVIEW

As described above, radio communication is used in a variety of applications, such as radio and television broadcasting, wireless networking, satellite communication, navigation, military applications, and the like, in which radio waves (e.g., electromagnetic radiation) are used to transmit information (e.g., data) across space. These applications, such as radio navigation or RADAR, may leverage or otherwise rely upon antenna devices in order to emit generated radio signal signals and/or receive emitted radio signal. With reference to FIG. 1, for example, an example antenna assembly 100 in a disk, cylindrical, or circular configuration is shown. Similarly, with reference to FIGS. 2A-2C, an example assembly 200 in a rectangular configuration is shown. Each of these assemblies 100, 200 are formed of a plurality of distinct, disparate, or separate components that are, for example, bolted, welded, or otherwise secured to one another so as to form an antenna assembly that is a collection of the plurality of separate components.

As shown in the bottom view of FIG. 1, the antenna assembly 100 may include a body 102 that includes at bottom portion 104 upon which various components may be secured. For example, the antenna assembly 100 may include a plurality of feed structures or waveguides 108 that direct electromagnetic radiation (e.g., radio signals) along the bottom portion 104 of the antenna assembly 100, and these feed structures 108 may further define one or more bottom openings 106 configured to operably couple the antenna assembly 100 to an example radio transceiver (not shown). These feed structures 108 may be, for example, bolted, secured, or otherwise attached to the bottom portion 104 (e.g., via one or more fasteners, welding, etc.). Furthermore, the portions that form the body 102 of the antenna assembly (e.g., a bottom portion 104, a corresponding front portion (not shown), and one or more side portions (not shown) extending therebetween) may be similarly bolted, secured, or otherwise attached together so as to form the body 102.

Figure 2A:
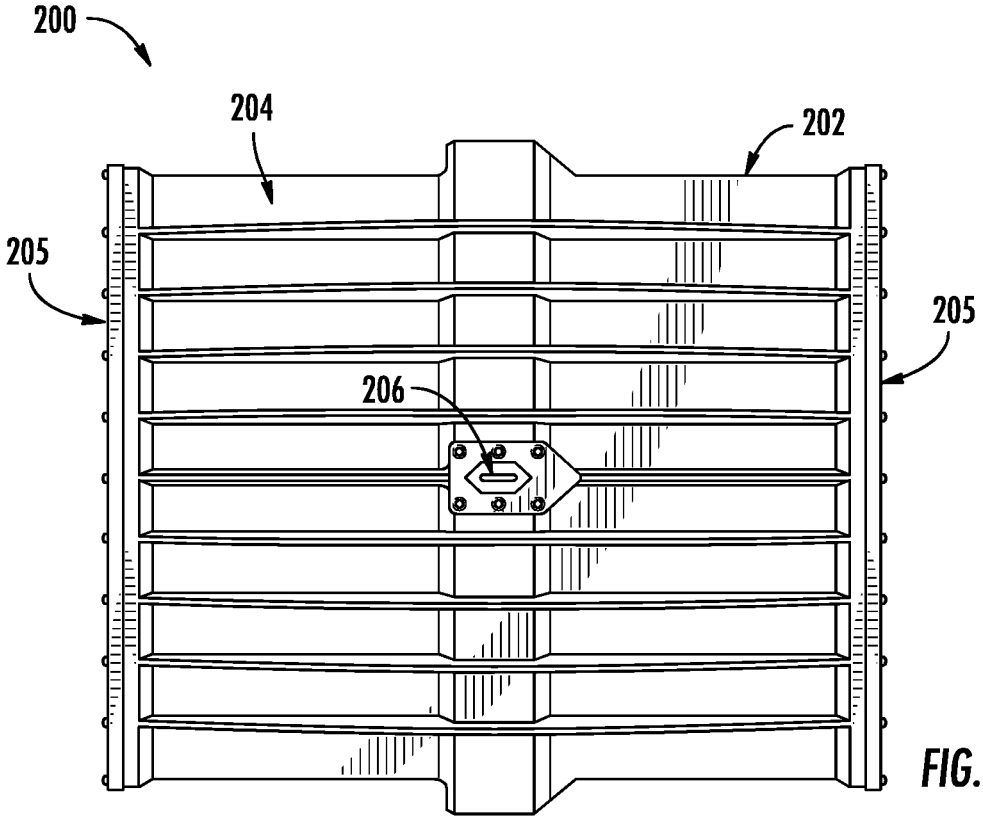
FIGS. 2A-2C illustrate various views of another modular or disparate antenna assembly formed of a plurality of distinct elements in a rectangular configuration.
Figure 2B:
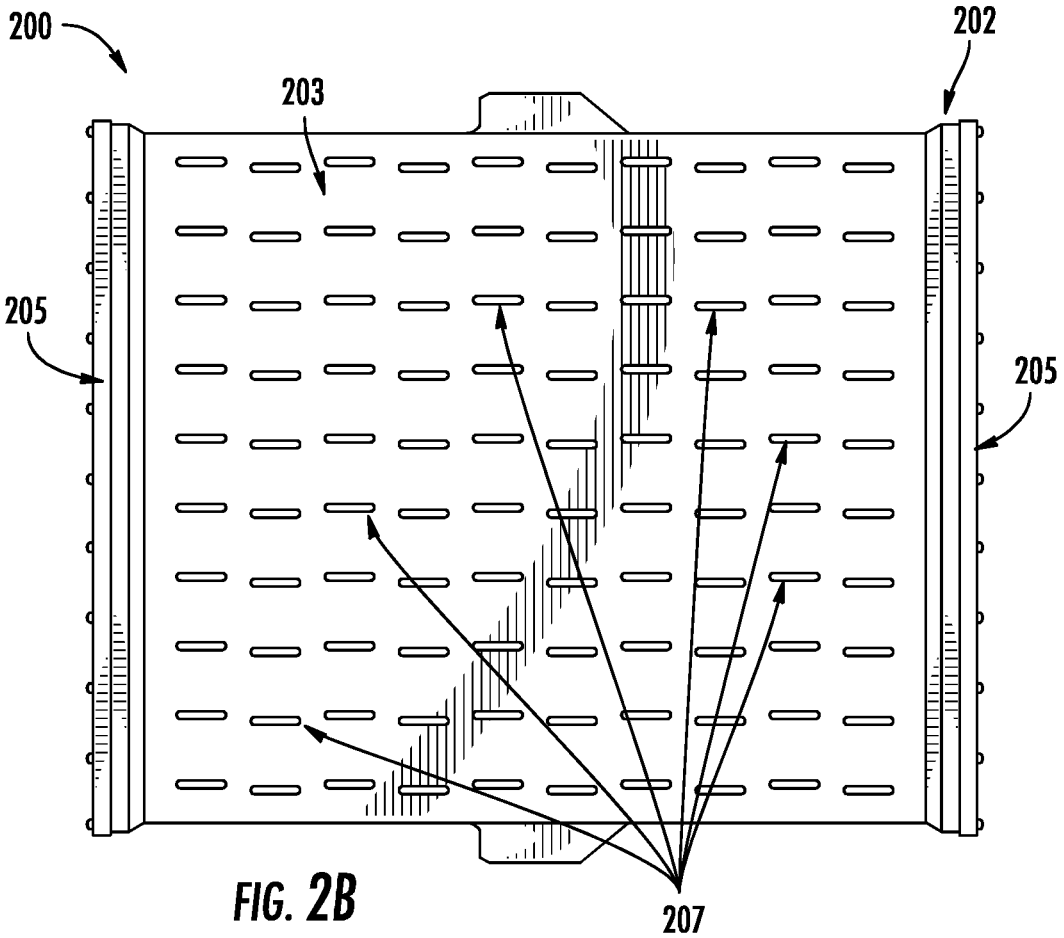
Figure 2C:
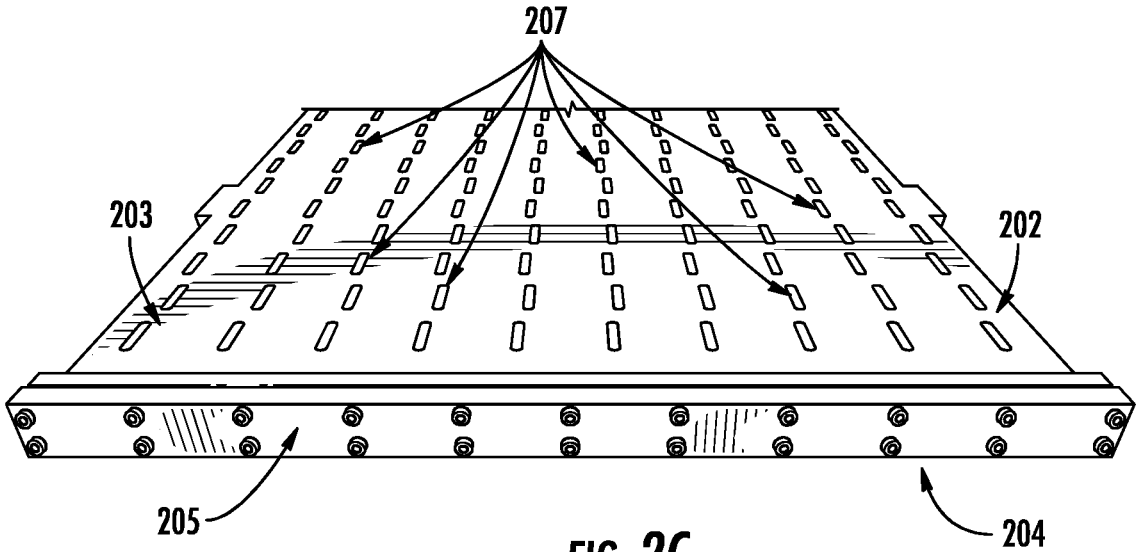

As shown in FIGS. 2A-2C, the antenna assembly 200 may include a body 202 that includes a bottom portion 204, a top portion 203, and one or more side portions 205 extending therebetween so as to form the body 202. As shown in FIG. 2C, the one or more side portions 205 may be bolted to the bottom portion 204 and the top portion 203. Similar to the antenna assembly of FIG. 1, the bottom portion 204 may define one or more openings 206 and/or conduits, channels, etc. configured to operably couple the antenna assembly 200 to an example radio transceiver (not shown). By way of example, a radio transceiver (not shown) may be operably or communicably coupled with the antenna assembly 200 via the opening 206 in the bottom portion 204 of the body 202. Electromagnetic radiation (e.g., radio waves or signals) may propagate through the body 202 from the bottom portion 204 to the top portion 203 and be emitted by the antenna assembly 200 via a plurality of top openings 207 in the top portion 203.

As would be evident in light of the present disclosure, each mechanical interface, attachment mechanism, or the like required to assemble these antenna assemblies 100, 200 (e.g., formed of disparate and distinct elements), may interfere with or otherwise impact the corresponding signal (e.g., electromagnetic radiation) transmitted by these antenna assemblies 100, 200. By way of example, the mechanical attachment between the feed structures or waveguides 108 and the bottom portion 104 of antenna assembly 100 may at least partially result in signal back reflection, signal refraction, energy loss, and/or otherwise result in degradation of the radio signals (e.g., electromagnetic radiation) transmitted by the antenna assembly 100. By way of an additional example, the mechanical attachment between the one or more side portions 205 and the top portion 203 and/or the bottom portion 204 may at least partially result in signal back reflection, signal refraction, energy loss, and/or otherwise impact the radio signals (e.g., electromagnetic radiation) transmitted by the antenna assembly 200. Furthermore, the mechanical complexity associated with forming the respective bodies 102, 202 of the antenna assemblies 100, 200 may result in substantial increased manufacturing costs.

These considerations are further complicated in high frequency embodiments in which the overall size or form factor of the antenna is reduced. As would be evident in light of the present disclosure, as the intended frequency of the application increases, the corresponding dimensions (e.g., size and shape) of the antenna decreases. For example, an antenna configured for use within the $K_a$ band or higher (e.g., greater than 26.5 Ghz) may result in a diameter of the antenna that is approximately six (6) inches. Due to the reduced cross-sectional area associated with the antenna bodies used in these high frequency applications, the ability to eliminate or reduce the impact of these mechanical interfaces is greatly hindered and the mechanical complexity associated with these designs is increased. Furthermore, many methods or processes for forming these antenna assemblies rely upon immersion of the antenna body (e.g., body 102, body 202, etc.), in whole or in part, within a brazing liquid. These processes, however, often result in residual salts or other residues within the body that may further impact the performance of the antenna (e.g., by interfering with the radio signals transmitted therethrough). Additionally, these immersion-based processes may provide further difficulties in that it may be difficult to control where excess brazing liquid is directed resulting in degradation of the physical structure of these conventional antenna assemblies (e.g., an enlarged or inconsistent fillet at joined components) which may result in performance degradation. Although described above with reference to a flat-plate antenna that is operational at frequencies in the $K_a$ band or greater and having a diameter (e.g., in the case of a disc, cylindrical, or circular configuration) of approximately six (6) inches, the present disclosure contemplates that embodiments described herein may operate to address applications at any frequency and having any corresponding dimensions.

To solve these issues and others, example implementations of embodiments of the present disclosure provide a flat-plate antenna formed of an integral body in which the portions (e.g., top portion, bottom portion, side portions, etc.) of the body of the flat-plate antenna are formed as an integral body. As described hereafter, the body may be formed from a single piece of material or otherwise be formed as a monolithic structure so as to improve the operational capabilities of the flat-plate antenna (e.g., by removing or otherwise reducing potential sources of interference or signal degradation) and reduce the mechanical complexity associated with manufacturing these structures. In some embodiments, the flat-plate antenna may include various other structures, such as one or more feed structures or waveguides, one or more turning portions, a manifold body, etc., that may also be formed integral to the body of the antenna. In doing so, the flat-plate antenna configuration described herein may provide an integral, monolithic structure that may be formed from or otherwise be identical to a single piece of material to avoid the operational and performance pitfalls associated with antenna assemblies formed of disparate, distinct, or separate components.

Flat-Plate Antenna and Associated Antenna Systems

Figure 3A:
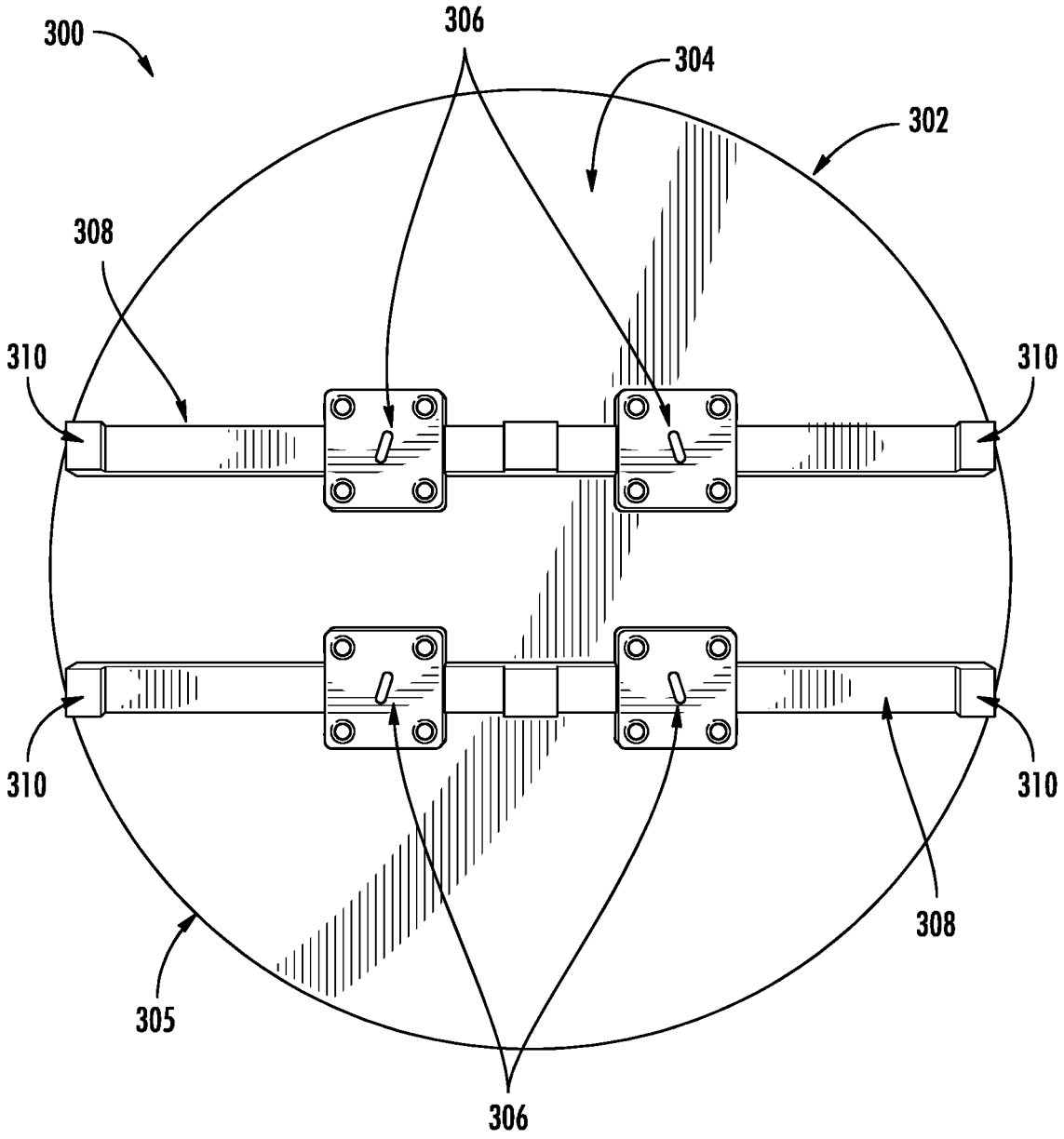
FIG. 3A illustrates a bottom perspective view of an integral flat-plate antenna configuration of the present disclosure in accordance with some example embodiments described herein.

Turning to FIG. 3A, a flat-plate antenna 300 of the present disclosure is shown that includes an integral body 302 that defines or is otherwise defined by a bottom portion 304, a top portion (e.g., see top portion 303 in FIG. 3B), and one or more side portions 305 extending therebetween. As described with respect to the operation of the flat-plate antenna 300, the body 302 may define a channel at least partially enclosed by the body 302. By way of example, the body 302 as defined by the top portion 303, the bottom portion 304, and the side portion(s) 305 may be such and an enclosure, container, waveguide, conduit, channel, or the like is formed within this integral body 302 such that electromagnetic radiation (e.g., radio signals) may be transmitted through the body 302. As shown in each of FIGS. 3A-3C, the top portion 303, the bottom portion 304, and the side portion(s) 305 may be dimensioned (e.g., sized and shaped) so as to form a body 302 having a circular cross-section (e.g., a cylindrical, disk, or otherwise circular configuration). Although illustrated in FIGS. 3A-3C as an integral body 302 having a circular cross-section, the present disclosure contemplates that the integral body 302 may define any shape, size, dimension, etc. based upon the intended application of the flat-plate antenna 300 of the present disclosure. For example, the integral body 302 of the flat-plate antenna 300 may define a rectangular cross-sectional, such as shown in the antenna assembly 200 of FIGS. 2A-2C.

The body 302 of the flat-plate antenna 300 may be an integral body in that the body 302 is formed as a monolithic structure and/or from a single piece of material. By way of example, the present disclosure contemplates that the integral body 302 may be formed via machining, extruding, or via other subtractive manufacturing techniques and may further be, in some embodiments, formed via an additive manufacturing technique, or vacuum brazing technique. As such, the terms formed from a single piece of material as used herein may refer to an integral body that is substantially identical in structure and composition to a solid piece of material, such as found in additive manufacturing (e.g., the composition of the integral body is indistinguishable from a forged body, extruded body, etc.). Furthermore, as described hereafter with reference to the method of FIG. 5, the integral body 302 may form a channel that is substantially free of residue (e.g., residual salts or the like) due to the lack of immersion or dip brazing based processes leveraged by the present disclosure (e.g., a "brazeless" implementation).

Figure 3B:
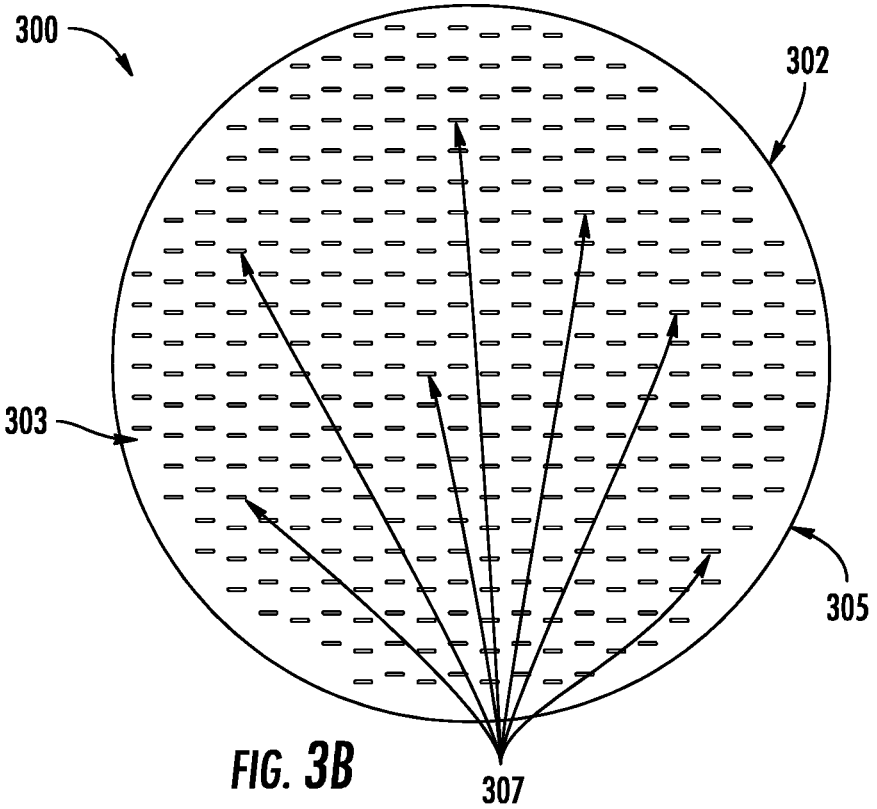
FIG. 3B illustrates a top perspective view of an integral flat-plate antenna configuration of the present disclosure in accordance with some example embodiments described herein.
Figure 3C:
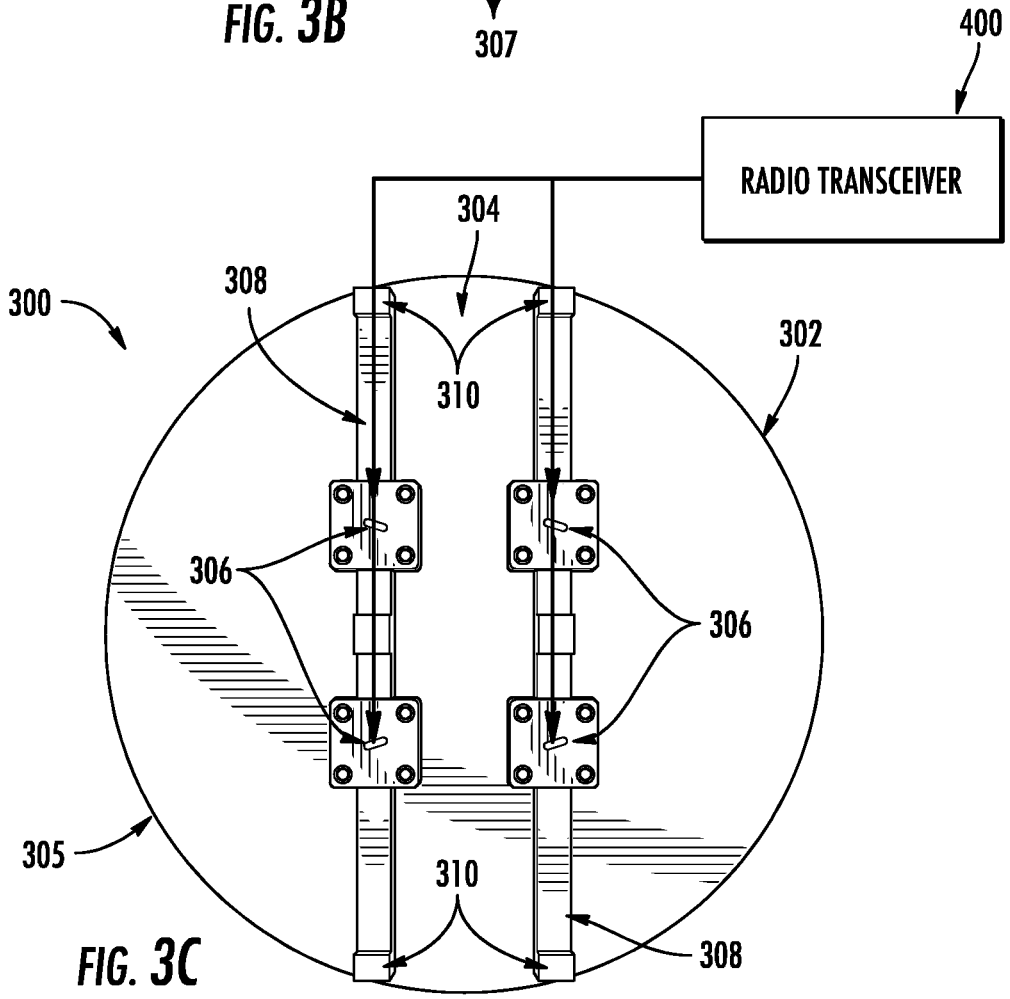
FIG. 3C illustrates a bottom perspective view of the integral flat-plate antenna configuration of FIG. 3B in accordance with some example embodiments described herein.

The flat-plate antenna 300 may further include a plurality of top openings 307 formed in the top portion 303 as shown in FIG. 3B and one or more bottom openings 306 formed in the bottom 304 as shown in FIGS. 3A and 3C. As would be evident in light of the operation of the flat-plate antenna 300, the one or more openings 306 in the bottom portion 304 of the body may be operably or communicably coupled with corresponding openings (e.g., inlets or outlets based upon the operation of the radio transceiver 400) of a radio transceiver 400 so as to transmit and/or receive electromagnetic radiation (e.g., radio waves, radio signals, or the like) emitted by the radio transceiver 400. The plurality of top openings 307 in the top portion 303 may be configured to be operably coupled (e.g., in communication with) an external environment of the flat-plate antenna 300 so as to emit electromagnetic radiation (e.g., radio waves, radio signals, etc.) and/or so as to receive electromagnetic radiation (e.g., radio waves, radio signals, etc.). In this way, the integral body 302 of the flat-plate antenna 300 may be configured such that the plurality of top openings 307 are in communication with (e.g., or otherwise operably coupled with) the one or more bottom openings 306 via the channel, conduit, waveguide, etc. formed in the integral body 302 such that, in operation, electromagnetic radiation may pass therebetween.

By way of example, the radio transceiver 400 may be configured to, in some embodiments, operate as a radio transmitter in which the radio transceiver 400 generates electromagnetic radiation (e.g., radio waves, radio signals, etc.) for transmission via the flat-plate antenna 300. In such an embodiment, the radio transceiver 400 may generate electromagnetic radiation (e.g., radio waves, radio signals, etc.) that are received by the integral body 302 via the one or more bottom openings 306. The generated electromagnetic radiation (e.g., radio waves, radio signals, etc.) may propagate through the integral body 302 (e.g., via the channel, conduit, waveguide, etc. formed by the integral body) to the one or more top openings 307 in the top portion 303 and be emitted by the flat-plate antenna 300 into the external environment of the antenna 300. Additionally or alternatively, the radio transceiver 400 may be configured to, in some embodiments, operate as a radio receiver in which the one or more top openings 307 in the top portion 303 may receive electromagnetic radiation (e.g., radio waves, radio signals, etc.), such as emitted from another antenna (not shown). The received electromagnetic radiation (e.g., radio waves, radio signals, etc.) may propagate through the integral body 302 (e.g., via the channel, conduit, waveguide, etc. formed by the integral body) to the one or more bottom openings 306 in the bottom portion 304 and be received by the radio transceiver 400. To this end, the radio transceiver 400 may include any number of circuitry components, processors, memories, etc. necessary to generate electromagnetic radiation (e.g., radio waves, radio signals, etc.) and/or to receive electromagnetic radiation (e.g., radio waves, radio signals, etc.). Although described herein with reference to radio waves or radio signals as an example electromagnetic radiation, the present disclosure contemplates that the flat-plate antenna 300 and integral body 302 may be configured for use with electromagnetic radiation of any type, frequency, wavelength, etc. based upon the intended application of such an antenna system.

In some embodiments, the integral features of the integral body 302 may be extended to further include other components that, in current antenna assemblies, are formed as disparate, distinct, or otherwise separate components. For example, and as shown in FIGS. 3A and 3C, the flat-plate antenna 300 may further include one or more feed structures 308 formed integral with the bottom portion 304 of the integral body 302. As shown, the one or more feed structures 308 may comprise or otherwise include the one or more bottom openings 306 and, as such, may operably connect or provide communication between the one or more bottom openings 306 and the channel formed within the integral body 302. By way of example, the one or more feed structures 308 may be formed as conduits, channels, waveguides, etc. that are formed integral to the bottom portion 304 of the integral body 304. As such, electromagnetic radiation (e.g., radio waves, radio signals, etc.) received by the flat-plate antenna 300 from, for example, the radio transceiver 400 may be directed along at least a segment of the bottom portion 304 of the integral body 302. In such an embodiment, the one or more feed structures 308 may similarly be formed as a monolithic structure and/or formed from a single piece of material as defined above.

In some embodiments, the one or more feed structures 308 may define one or more corresponding turning portions 310 configured to short at least a portion of the electromagnetic radiation (e.g., radio waves, radio signals, etc.) traveling between the bottom portion 304 and the top portion 303 (e.g., at least a portion of the electromagnetic radiation within the one or more feed structures 308). As would be evident to one of ordinary skill in the art in light of the present disclosure, the one or more turning portions 310 may be used in embodiments in which the overall formfactor (e.g., size, shape, dimensions, etc.) of the flat-plate antenna 300 is reduced. In other embodiments, the one or more feed structures 308 may, for example, extend beyond a peripheral edge of the flat plate antenna 300 (e.g., without turning portions 310). As shown, at least one of the one or more turning portions 310 may be disposed or otherwise positioned at a juncture between the bottom portion 304 and the one or more side portions 305 such that electromagnetic radiation (e.g., radio waves, radio signals, etc.) traveling along the one or more feed structures 308 may be shorted at this location (e.g., without extending beyond a peripheral edge of the flat plate antenna 300 as may be present in alternative embodiments). In any embodiment, the one or more turning portions 310 may similarly be formed as a monolithic structure and/or formed from a single piece of material as defined above. Furthermore, although illustrated with four (4) feed structures 308 and eight (8) corresponding turning portions 310 in FIGS. 3A and 3C (e.g., two (2) turning portions per bottom opening 306), the present disclosure contemplates that the flat-plate antenna 300 may include any number of feed structures 308 and corresponding turning portions 310 based upon the intended application of the example antenna system.

Figure 4:
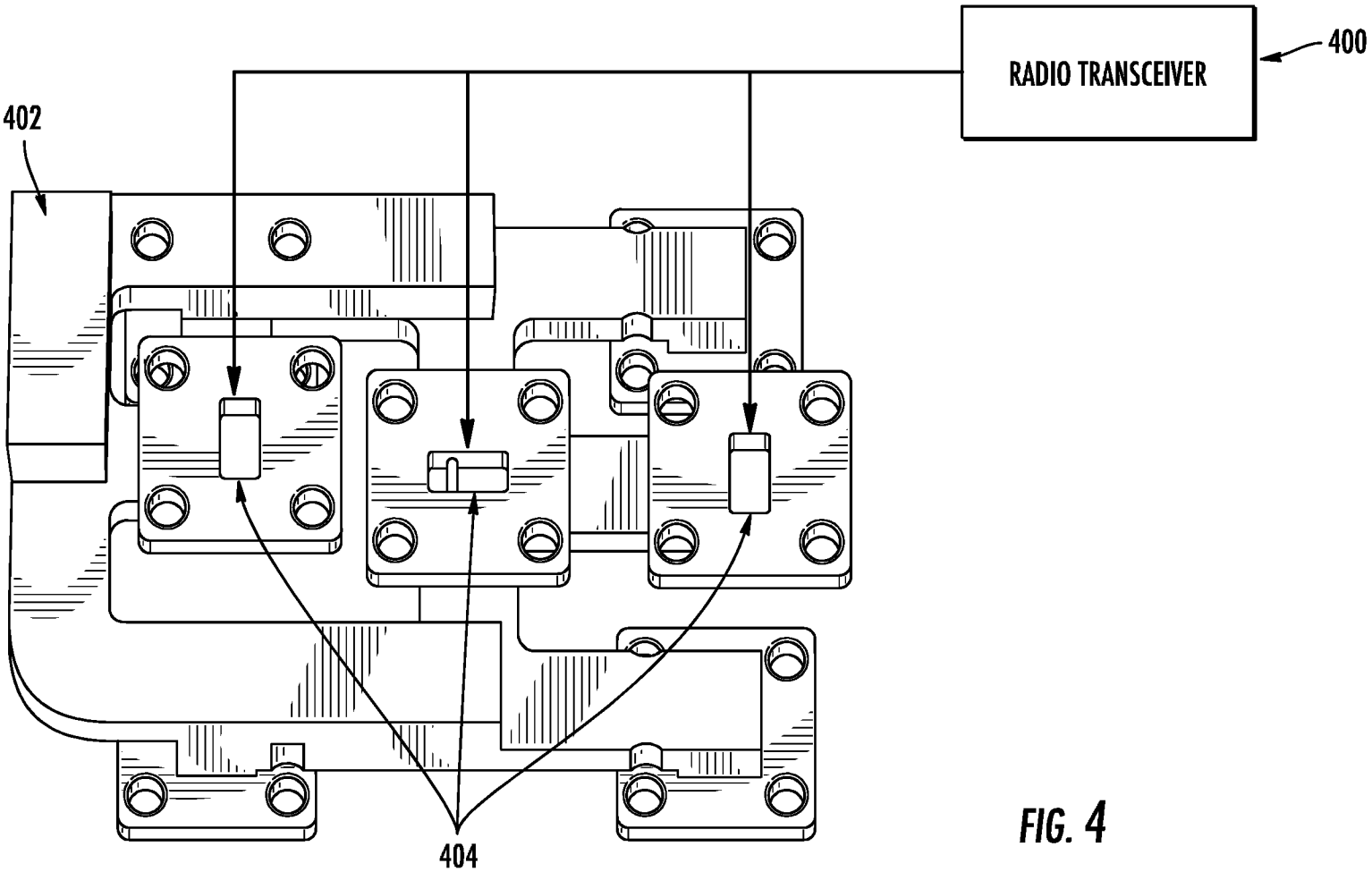
FIG. 4 illustrates a bottom perspective view of an example integral manifold body (e.g., shown separated from an integral flat-plate antenna) in accordance with some example embodiments described herein.

With reference to FIG. 4, in some embodiments, the flat-plate antenna 300 may further include a manifold body 402 that may be formed integral with the one or more feed structures 308 or otherwise integral with the bottom portion 304 of the integral body 302. As would be evident in light of the present disclosure, flat-plate antennas, such as antenna 300, may utilize manifold bodies 402 so as to properly distribute electromagnetic radiation (e.g., radio waves, radio signals, etc.) into the integral body 302. For example, the manifold body 402 may define one or more manifold openings 404 configured to be operably or communicably coupled with the radio receiver 400. Although illustrated in FIG. 4 as separate from the flat-plate antenna 300 for clarity, the present disclosure contemplates that the manifold body 402 may further be formed integral with the integral body 302 of the antenna 300. In such an embodiment, the manifold body 402 may similarly be formed as a monolithic structure and/or formed from a single piece of material as defined above.

Example Method of Manufacturing

Figure 5:
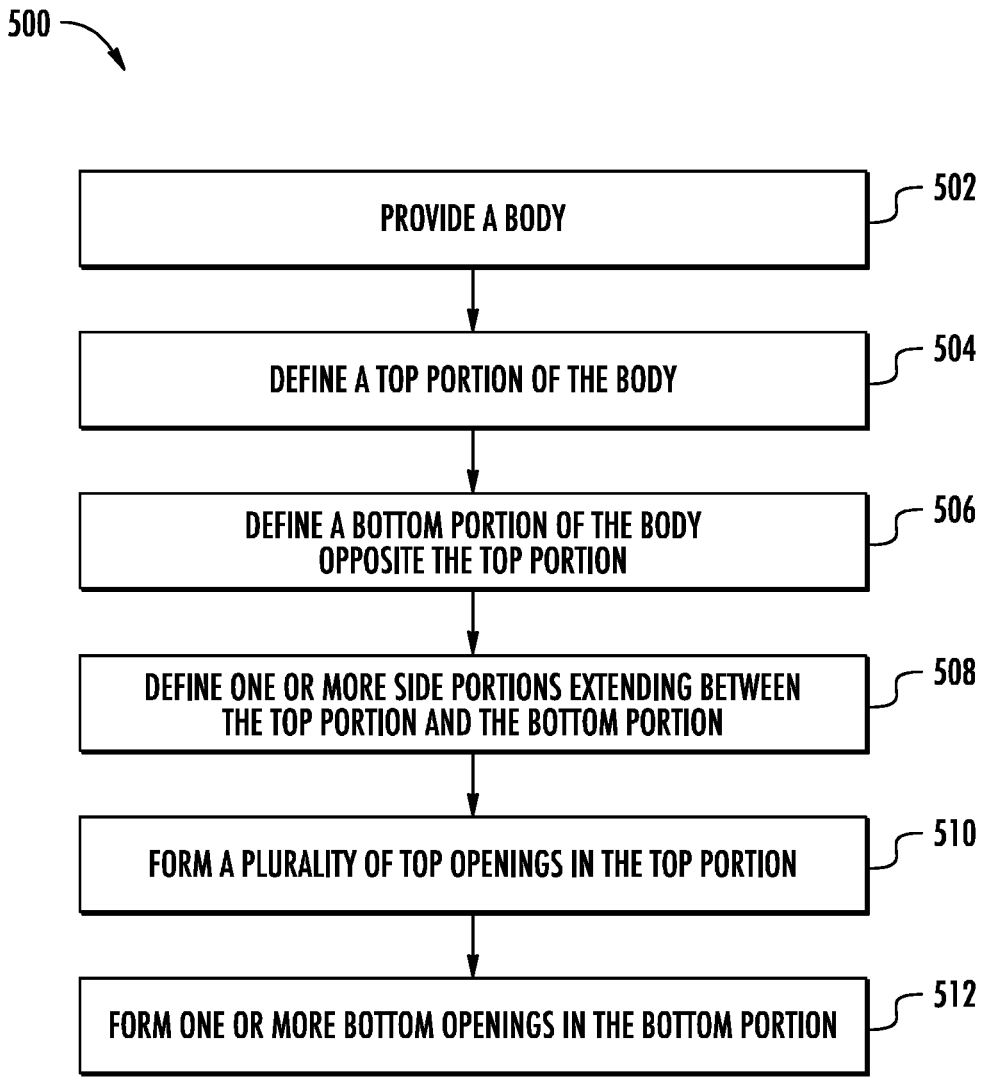
FIG. 5 illustrates an example method of manufacturing of an integral flat-plate antenna configuration of the present disclosure in accordance with some example embodiments described herein.

With reference to FIG. 5, an example method of manufacturing a flat-plate antenna having an integral body is illustrated. The method (e.g., method 500) may include the step of providing a body at operation 502, include the step of defining a top portion of the body at operation 504, include the step of defining a bottom portion of the body opposite the top portion at operation 506, and/or include the step of defining one or more side portions extending between the top portion and the bottom portion at operation 508. As described above, the integral body of the flat-plate antenna defines or is otherwise defined by a bottom portion, a top portion, and one or more side portions extending therebetween. The body may define a channel at least partially enclosed by the body. By way of continued example, the body as defined by the top portion, the bottom portion, and the side portion(s) may be such and an enclosure, container, waveguide, conduit, channel, or the like is formed within the body such that electromagnetic radiation (e.g., radio signals) may be transmitted through the body. Forming the top portion, the bottom portion, and the side portion(s) may include dimensioning these features so as to form a body having a circular cross-section (e.g., a cylindrical, disk, or otherwise circular configuration). Although described herein as an integral body having a circular cross-section, the present disclosure contemplates that the integral body may define any shape, size, dimension, etc. based upon the intended application of the flat-plate antenna of the present disclosure. For example, forming the integral body at these operations may include defining a rectangular cross-sectional area of the integral body, such as shown in the antenna assembly of FIGS. 2A-2C.

As described above, the body of the flat-plate antenna may be an integral body in that the body may be formed as a monolithic structure and/or from a single piece of material. By way of example, the present disclosure contemplates that the integral body may be formed via machining, extruding, or via other subtractive manufacturing techniques and may further be, in some embodiments, formed via an additive manufacturing techniques, vacuum brazing techniques, or the like. As such, the terms formed from a single piece of material as used herein may refer to an integral body that is substantially identical in structure and composition to a solid piece of material, such as found in additive manufacturing (e.g., the composition of the integral body is indistinguishable from a forged body, an extruded body, etc.). The integral body may form a channel that is substantially free of residue (e.g., residual salts or the like) due to the lack of immersion or dip brazing based processes leveraged by the present disclosure (e.g., a "brazeless" implementation).

Thereafter, the method (e.g., method 500) may include the step of forming a plurality of top openings in the top portion at operation 510 and may include the step of forming a plurality of bottom openings in the bottom portion at operation 512. As described above, the one or more opening in the bottom portion of the body may be operably or communicably coupled with corresponding openings (e.g., inlets or outlets based upon the operation of the radio transceiver) of a radio transceiver so as to receive electromagnetic radiation (e.g., radio waves, radio signals, or the like) emitted by the radio transceiver. The plurality of top openings in the top portion may be configured to be operably coupled (e.g., in communication) with an external environment of the flat-plate antenna so as to emit electromagnetic radiation (e.g., radio waves, radio signals, etc.) and/or so as to receive electromagnetic radiation (e.g., radio waves, radio signals, etc.). In this way, the integral body of the flat-plate antenna may be configured such that the plurality of top openings are in communication with (e.g., or otherwise operably coupled with) the one or more bottom openings via the channel, conduit, waveguide, etc. formed in the integral body such that, in operation, electromagnetic radiation may pass therebetween.

The embodiments described herein may also be scalable to accommodate at least the aforementioned applications. Various components of embodiments described herein can be added, removed, reorganized, modified, duplicated, and/or the like as one skilled in the art would find convenient and/or necessary to implement a particular application in conjunction with the teachings of the present disclosure. In various embodiments, the order of operations in manufacturing the flat-plate antenna may be modified. Moreover, specialized features, characteristics, materials, components, and/or equipment may be applied in conjunction with the teachings of the present disclosure as one skilled in the art would find convenient and/or necessary to implement a particular application in light of the present disclosure.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

The invention claimed is:

1. A flat-plate antenna comprising:
an integral body defining:
a top portion;
a bottom portion opposite the top portion; and
one or more side portions extending therebetween, wherein the body defines a channel at least partially enclosed by the body;
a plurality of top openings formed in the top portion;
one or more bottom openings formed in the bottom portion,
wherein the body is configured such that the plurality of top openings are in communication with the one or more bottom openings via the channel such that, in operation, electromagnetic radiation may pass therebetween; and
one or more feed structures formed integral with the bottom portion of the body,
wherein the one or more feed structures comprise one or more corresponding turning portions configured to short at least a portion of the electromagnetic radiation traveling within the one or more feed structures.

2. The flat-plate antenna according to claim 1, wherein the body is formed from a single piece of material.

3. The flat-plate antenna according to claim 1, wherein the body is formed as a monolithic structure.

4. The antenna system according to claim 1, wherein the one or more feed structures comprise the one or more bottom openings and communicably couple the bottom portion with the radio transceiver.

5. The flat-plate antenna according to claim 1, wherein at least one of the one or more turning portions are disposed at a juncture between the bottom portion and the one or more side portions.

6. The flat-plate antenna according to claim 1, further comprising a manifold body formed integral with the one or more feed structures of the bottom portion.

7. An antenna system comprising:
a radio transceiver;
a flat-plate antenna communicably coupled with the radio transceiver, the antenna comprising:
an integral body defining:
a top portion;
a bottom portion opposite the top portion; and
one or more side portions extending therebetween, wherein the body defines a channel at least partially enclosed by the body;
a plurality of top openings formed in the top portion of the body in communication with an external environment of the flat-plate antenna; and
one or more bottom openings formed in the bottom portion of the body in communication with the radio transceiver, wherein the body is configured such that:

electromagnetic radiation generated by the radio transceiver is directed from the radio transceiver to the external environment of the flat-plate antenna via the body;

electromagnetic radiation received by the flat-plate antenna by the plurality of top openings is directed from the external environment of the flat-plate antenna to the radio transceiver via the body; and one or more feed structures formed integral with the bottom portion of the body, wherein the one or more feed structures comprise one or more corresponding turning portions configured to short at least a portion of the electromagnetic radiation traveling within the one or more feed structures.

8. The antenna system according to claim 7, wherein the body of the flat-plate antenna is formed from a single piece of material.

9. The antenna system according to claim 7, wherein the body of the flat-plate antenna is formed as a monolithic structure.

10. The antenna system according to claim 7, wherein the one or more feed structures comprise the one or more bottom openings and communicably couple the bottom portion with the radio transceiver.

11. The antenna system according to claim 7, wherein at least one of the one or more turning portions are disposed at a juncture between the bottom portion and the one or more side portions.

12. The antenna system according to claim 7, further comprising a manifold body formed integral with the one or more feed structures of the bottom portion.

13. A method of manufacturing a flat-plate antenna, the method comprising:

providing a body;

defining a top portion of the body;

defining a bottom portion of the body opposite the top portion;

defining one or more side portions extending between the top portion and the bottom portion, wherein the body defines a channel at least partially enclosed by the body;

forming a plurality of top openings in the top portion;

forming one or more bottom openings in the bottom portion, wherein the body is configured such that the plurality of top openings are in communication with the one or more bottom openings via the channel such that, in operation, electromagnetic radiation may pass therebetween; and further comprising forming one or more feed structures integral with the bottom portion of the body, wherein the one or more feed structures comprise one or more corresponding turning portions configured to short at least a portion of the electromagnetic radiation traveling within the one or more feed structures.

14. The method according to claim 13, wherein the body is formed from a single piece of material.

15. The method according to claim 13, wherein the body is formed as a monolithic structure.

16. The method according to claim 13, wherein the one or more feed structures comprise the one or more bottom openings and provide communication between the one or more bottom openings and the channel.

17. The method according to claim 13, wherein at least one of the one or more turning portions are disposed at a juncture between the bottom portion and the one or more side portions.

18. The flat-plate antenna according to claim 1, wherein the one or more feed structures comprise one or more structures selected from a group consisting of conduits, channels, and waveguides.

19. The flat-plate antenna of claim 6, wherein the manifold body defines one or more manifold openings configured to be operably or communicably coupled with the radio transceiver.

20. The antenna system of claim 12, wherein the manifold body defines one or more manifold openings configured to be operably or communicably coupled with the radio transceiver.

* * * * *